US006467874B1

(12) United States Patent
Williams et al.

(10) Patent No.: US 6,467,874 B1
(45) Date of Patent: Oct. 22, 2002

(54) PEN POSITIONING IN PAGE WIDE ARRAY PRINTERS

(75) Inventors: Kenneth R. Williams, Vancouver, WA (US); Ernesto A. Garay, Gresham, OR (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/940,322

(22) Filed: Aug. 27, 2001

(51) Int. Cl.[7] ..... B41J 2/155
(52) U.S. Cl. ..... 347/42
(58) Field of Search ..... 347/42, 12, 108, 347/49

(56) References Cited

U.S. PATENT DOCUMENTS 5,469,199 A * 11/1995 Allen et al. ..... 347/42
6,350,013 B1 * 2/2002 Scheffelin et al. ..... 347/42
6,352,329 B1 * 3/2002 Watanabe et al. ..... 347/42

* cited by examiner

*Primary Examiner*—Lamson Nguyen
(74) *Attorney, Agent, or Firm*—Roth & Goldman

(57) ABSTRACT

A method and apparatus for positioning a fluid ejection device such as an inkjet pen, or a plurality of aligned fluid ejection devices, on a supporting frame known as a printbar for page wide array printing involves provision of datum surfaces on each ejection device extending in three orthogonally related planes. The datum surfaces on the fluid ejection devices mate with positioning surfaces on the printbar to hold each fluid ejection device in correct position. A datum surface on a laterally outwardly extending key on each device is engaged by a biasing spring mounted on the printbar to position the device lengthwise of the printbar and also to prevent incorrect installation of the device.

20 Claims, 7 Drawing Sheets

PEN POSITIONING IN PAGE WIDE ARRAY PRINTERS

BACKGROUND OF THE INVENTION

The present invention relates to the art of fluid ejection devices and, more particularly, to inkjet printers which use a plurality of pens supported in a page wide array in a frame referred to herein as a printbar which extends across a path of movement of media on which printing is to take place. The individual pens used in this field usually comprise generally rectangular configured fluid containing housings of molded plastic or other suitable material so that a number of pens can be aligned end-to-end in the printbar. Maximization of the size of the pens for ease of manufacture and close positioning of the pens in the printbar without pen to pen contact is important for accurate ink drop placement and in keeping size of the printer footprint to a minimum. for these reasons it is considered particularly advantageous to utilize pens which have protruding fore and aft lower orifice array portions on opposite sides of the lower portion of the pen so that the pens can be aligned with the fore and aft portions of adjacent pens in a side-to-side or nested relationship. These pens are rotationally symmetrical about a vertical axis. Electrical interconnects comprising conductive contacts arranged in a pattern are provided on opposite sides of the pen and mating electrical contacts are mounted on the frame for engagement with the interconnects on the pens for transmitting power to control the ejection of fluid from the pens. The pens must be closely and accurately positioned without contacting each other and they must each be stabilized against linear and rotational movement in the spaces on the printbar in which they are mounted.

Microscopic fluid droplets are ejected usually downwardly from thermal or piezoelectric printheads onto media on which a print pattern is to be produced from orifice arrays or orifice plates mounted on the lower surfaces of the pens. The need for precise alignment of the pens relative to each other and to the frame or printbar on which they are supported is quite apparent to those skilled in the art.

SUMMARY OF THE INVENTION

The present invention therefore provides a method of positioning a fluid ejection device in a support to stabilize the device against movement in at least one direction relative to said support comprising urging said device into engagement with said support by biasing a surface on said device which protrudes from one side of said device to urge said device in said direction.

The present invention further provides a fluid ejection assembly comprising a frame and at least one fluid ejection device positioned in a mounting location on said frame, said device including a housing for containing fluid and having a positioning member laterally protruding from one side of said housing, said frame having a guide at said mounting location for receiving said member to guide said device into said mounting location in said frame.

DETAILED DESCRIPTION OF THE PREFERRED EMBODIMENTS

Figure 1:
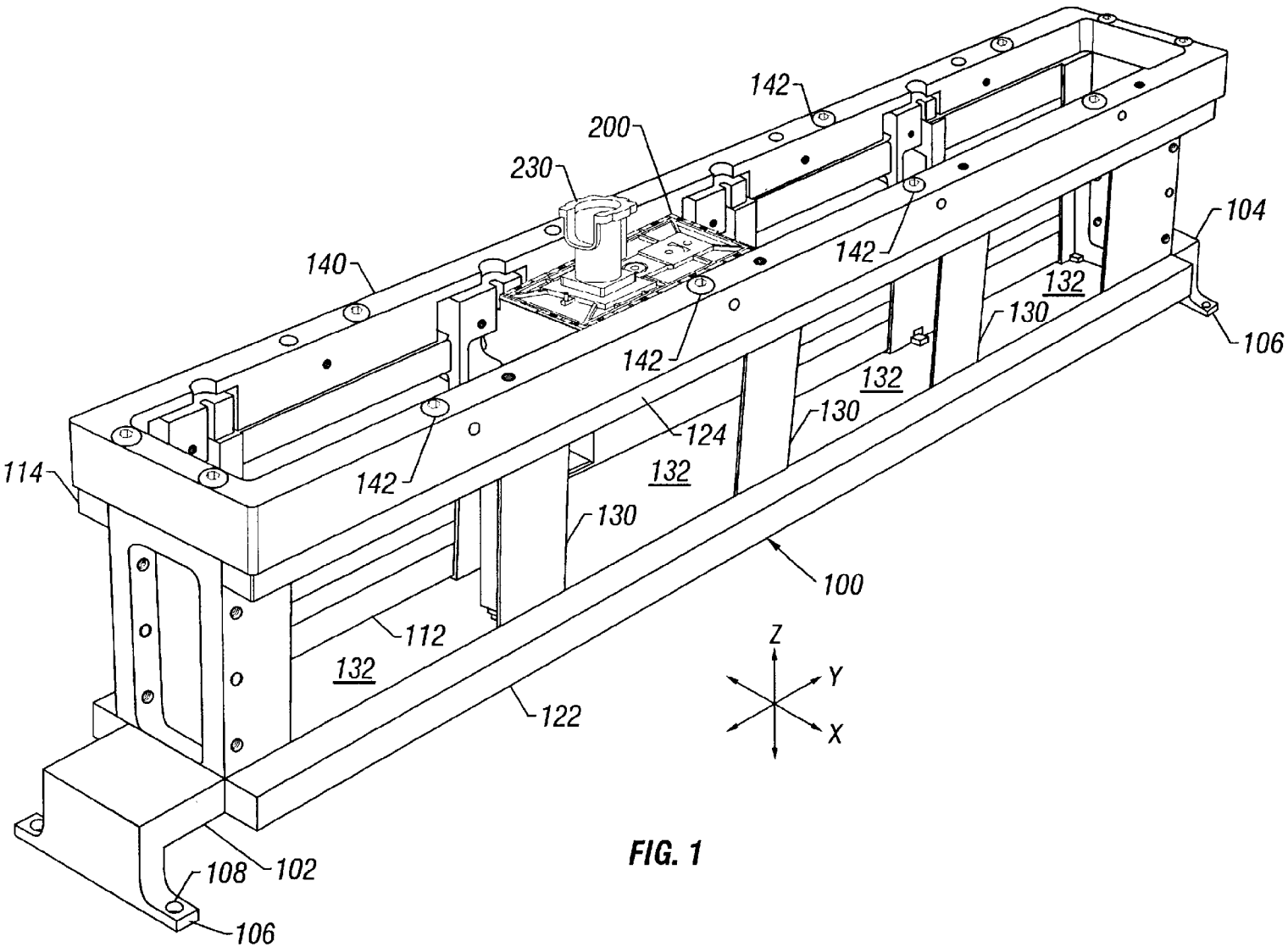
FIG. 1 is a perspective view of a printbar which holds a plurality of inkjet pens for a page wide array printer.

The invention will be described with reference to a rectangular coordinate system in which the X, Y and Z directions extend as seen in FIG. 1 A frame or printbar 100, elongated in the Y direction, is shown for supporting an aligned plurality of fluid ejection devices such as inkjet pens 200 includes spaced end pieces 102, 104 each having supporting feet 106 with apertures 108 for attaching of the printbar 100 to printer chassis structure. Each pen 200 must be accurately and repeatably positioned in the print bar 100 with respect to six degrees of freedom—three translational and three rotational. The exemplary printbar shown in the drawings includes a pair of spaced side frames each having elongated lower beams 112, 122 and upper beams 114, 124 connected by spaced columns 130 which extend in the Z direction which is generally vertical as shown. The spaced columns 130 define windows 132 therebetween for reception of electrical interconnects (not shown) assembled onto the printbar which mate with electrical interconnects on the inkjet pens when installed in the respective pen locations in the printbar 100. As seen when comparing the top plan view of FIG. 6 with the bottom plan view of FIG. 7, and in FIG. 9, the columns 130 and windows 132 are not directly aligned with each other on opposite sides of the printbar. A rectangular cover 140 may be provided and affixed to the upper beams 114, 124 and to the end pieces 102, 104 by a plurality of fasteners 142 or any other suitable means.

Figure 6:
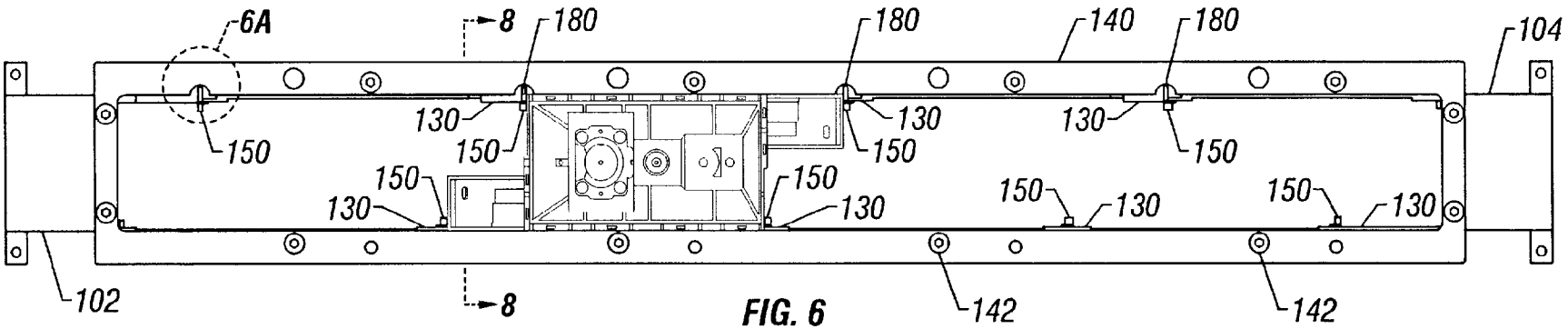
FIG. 6 is a top plan view of the printbar of FIG. 1 with one pen installed in a pen pocket therein and a broken away portion shown to an enlarged scale as FIG. 6A to show a Y-direction biasing spring.
Figure 6A:
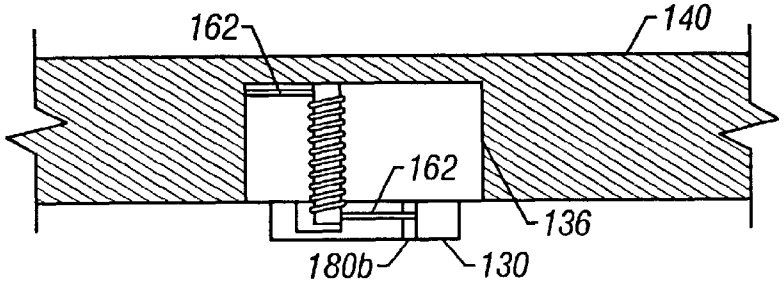
Figure 7:
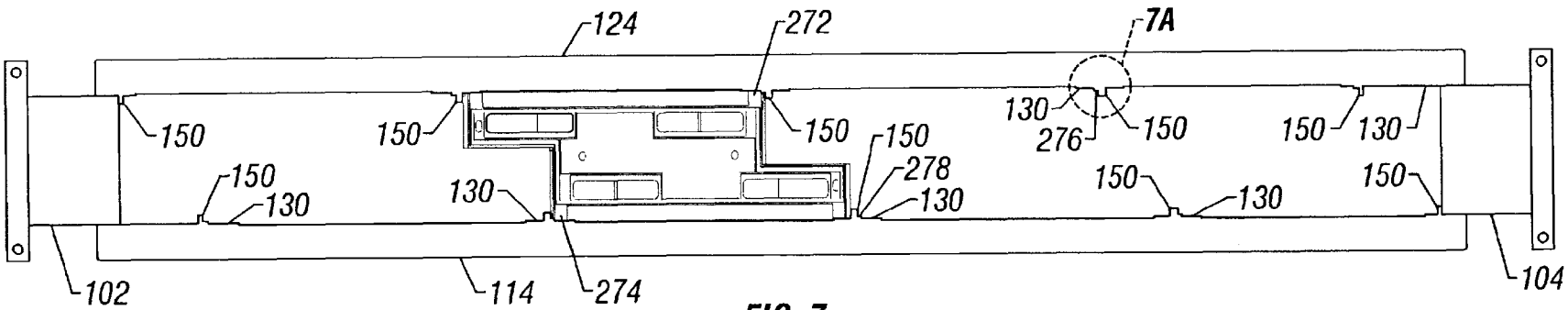
FIG. 7 is a bottom plan view of the printbar and pen seen in FIG. 6, FIG. 7A showing a portion thereof to an enlarged scale.
Figure 7A:
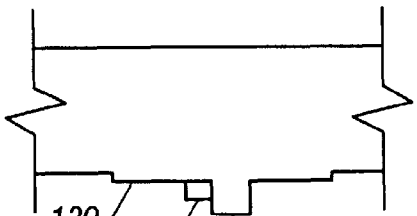
Figure 8:
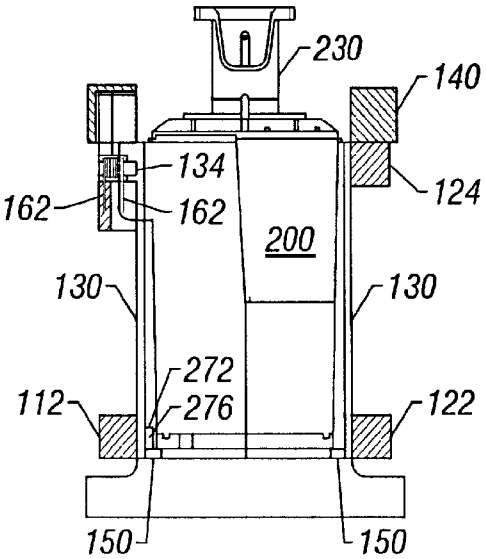
FIG. 8 is a vertical cross-section view taken at lines 8—8 on FIG. 6.
Figure 9:
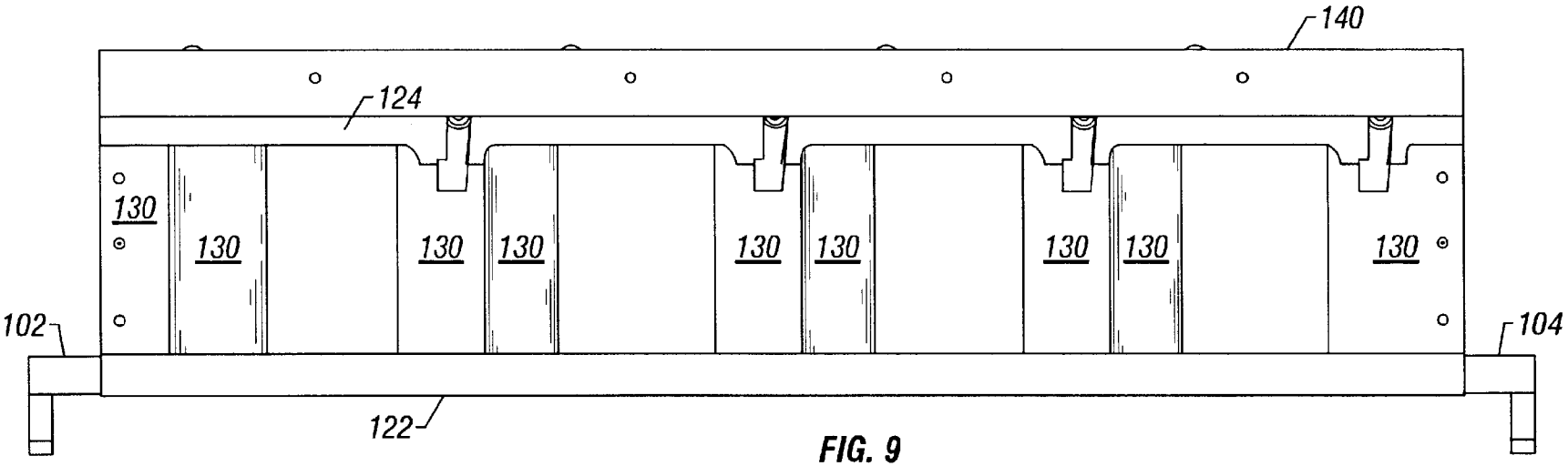
FIG. 9 is a rear side elevation view of the printbar partly broken away and showing the Y-direction biasing spring in FIG. 9A.

Spaced generally horizontally extending Z-datum supports 150 protrude inwardly of the frame in the X direction from the lower ends of the columns 130 for supporting the fluid ejection devices. Spring support posts 134 are affixed to or integrally formed with the columns 130 on one side of the printbar near the upper ends of the columns as seen in FIGS. 6, 8 and 9. Aligned cutouts 136 below the support posts 134 are provided in the upper portions of the columns 130 and upper beam 114 and cover 140 to afford clearance space for reception of pen positioning springs 160. The support posts 134 in one (124) of the upper beams 114, 124 each have a Y direction bias torsion spring 160 positioned thereon so that one free end of the spring 160 extends downwardly in the cutout 136 and engages a transversely extending surface of the upper beam 114 in the cutout 136 and the other free end of each of the springs 160 extends downwardly to engage a surface on each of the pens 200 as will be explained below to bias the individual pens lengthwise of the printbar 100 in the Y direction. Other functionally equivalent types of springs and spring mounts can of course be substituted for the torsion springs and mounting posts shown in the drawings.

Figure 9A:
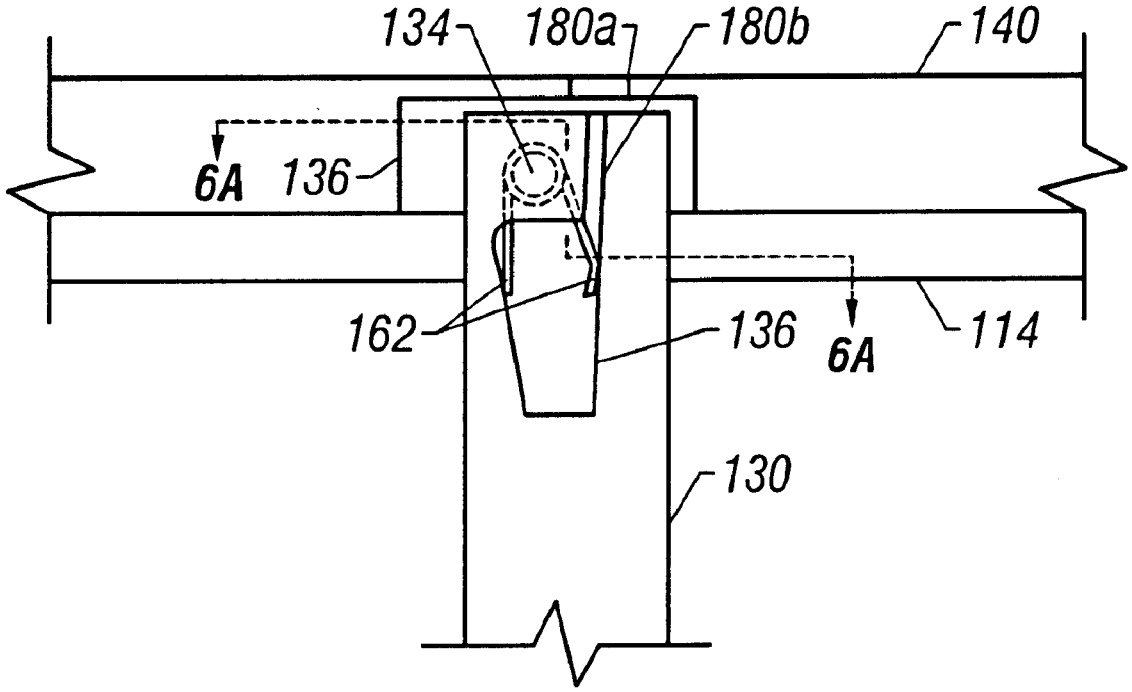

Spaced vertically extending guides in the form of keyways 180 best seen in FIG. 9A are also provided in the cover 140 (keyway portion 180*a*) and in the same upper beam (keyway portion 180*b*) in which the springs 160 are mounted in locations alongside the springs as shown to receive pen positioning members to be described. The keyways 180 open downwardly into the cutouts 136.

Figure 2:
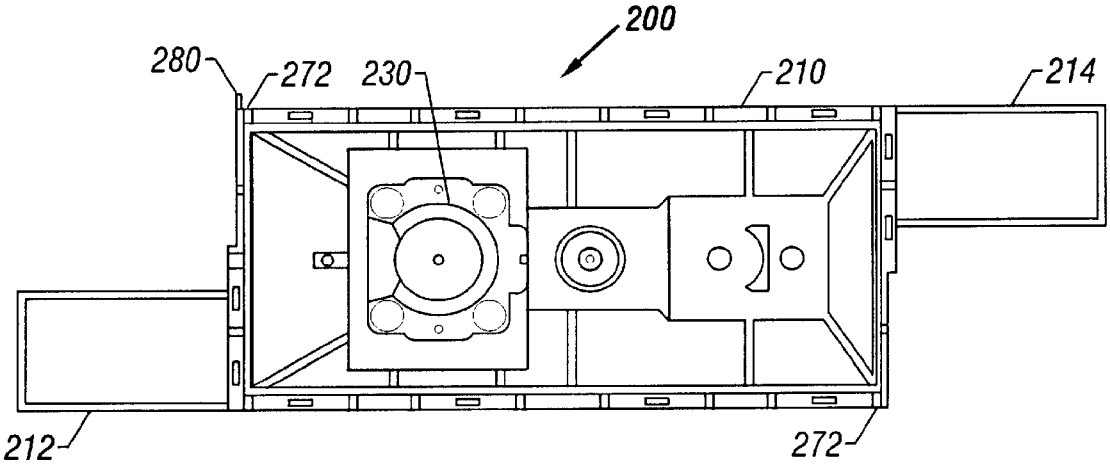
FIG. 2 is a top plan view of an inkjet pen.
Figure 4:
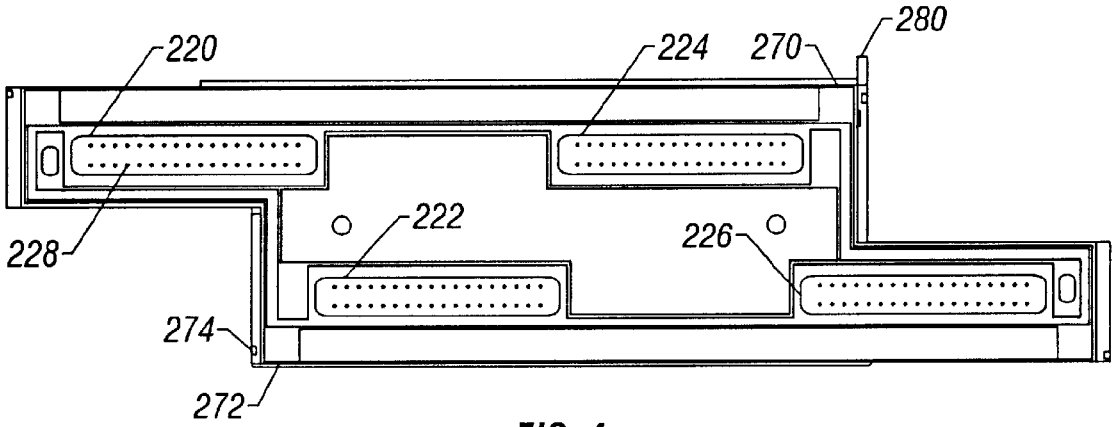
FIG. 4 is a bottom plan view of the pen of FIG. 2.

One or more fluid ejection devices such as inkjet pens 200 are received in individual mounting locations or pockets (four are shown in the illustrated example) in the printbar 100. Each pen 200 is comprised of a generally rectangular plastic housing 210 having protruding fore and aft portions 212, 214 at the lower portion of each pen so that the lower portion of each pen can be said to define a generally offset or S configuration as best seen in FIGS. 2 and 4. The bottom plan view of the pen seen in FIG. 4 shows four elongated overlapping (in the Y direction) nozzle arrays 220, 222, 224, 226 which each contain inkjet orifices 228 through which ink may be fired by electrical activation of fluid vaporizing resistors or by piezoelectric firing as is conventional. Each pen housing 210 may contain a supply of ink and may also be provided with a fill port 230 for replenishment of ink in the housing from remote sources of ink, not shown.

Generally rectangular recesses 240, 250 are formed in the offset lower portions 212, 214 of the housing for reception of electrical interconnects 242, 252 which may be resilient and engageable with similarly configured resilient electrical interconnects (not shown) which are positioned in the windows 132 of the printbar 100 during assembly of the printer so that fluid droplet firing energy can be supplied to each pen 200. The electrical interconnects 242, 252 are not directly aligned in the X direction since they are on the oppositely facing sides of the fore and aft lower portions 212, 214 of the housing 210.

Figure 3A:
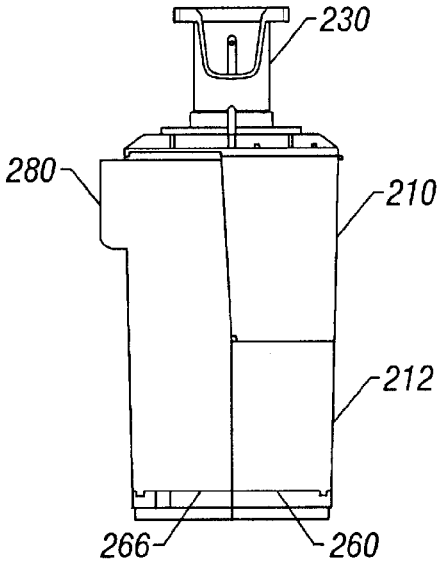
FIGS. 3A and 3B respectively comprise left and right side elevation views of the pen of FIG. 2.
Figure 3B:
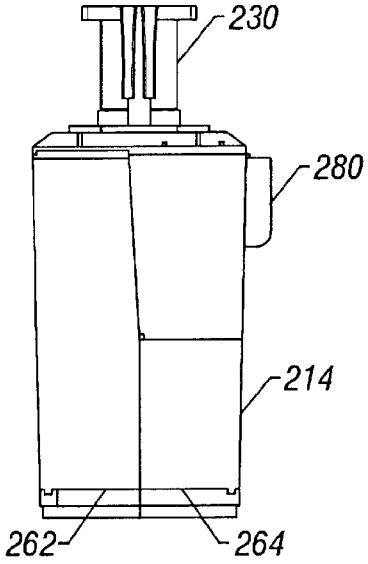
Figure 5A:
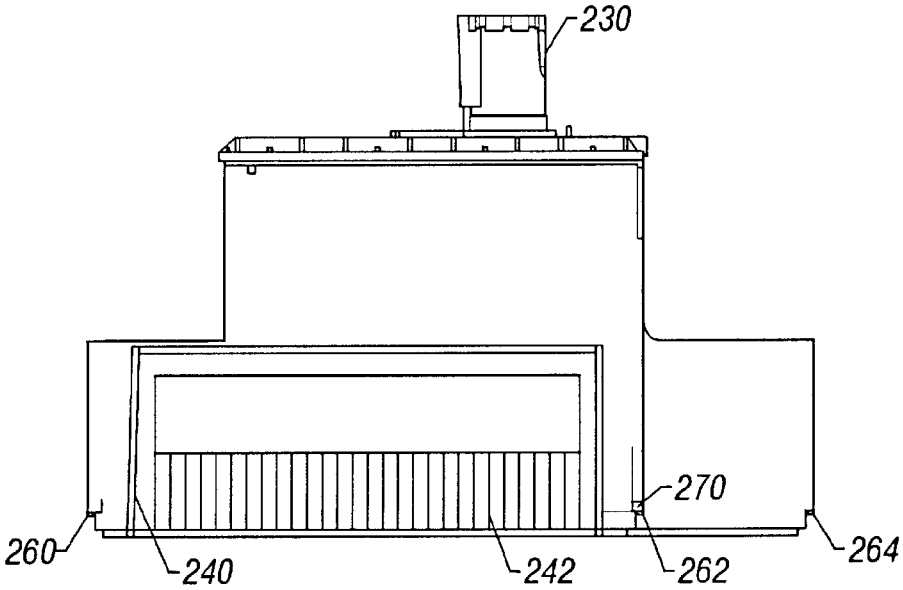
FIGS. 5A and 5B respectively comprise front and rear elevation views of the pen of FIG. 2.
Figure 5B:
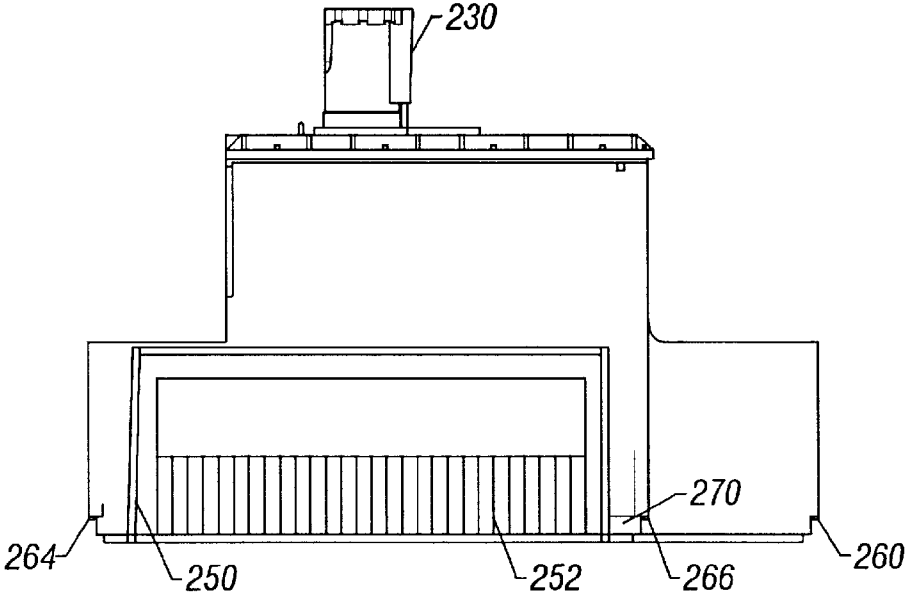

As seen in FIGS. 3 and 5, the pen housing 210 is configured with shoulders which define horizontally extending Z datum surfaces 260, 262, 264, 266 in the locations shown on the housing which engage the spaced Z datum supports 150 on the printbar 100 to provide accurate Z direction positioning and support for the pens 200 when properly positioned in the printbar 100. Three of the Z datum surfaces are operational and one is redundant and rotationally position each pen about the X and Y axes when the pen is held in place by a latch (not shown) which urges the pen in the Z direction to engage the Z datum surfaces with the supports 150.

Accurate positioning of the pens 200 in the X direction is provided by two vertically extending datum surfaces 270, 272 in the locations shown on the diagonally opposite lower corners of the main housing portion 210. These X datum surfaces 270, 272 engage X datum surfaces 274, 276 which slightly protrude inwardly from the inner faces of the columns 130 near the supports 150. The pens are held in the correct position by engagement of the X datum surfaces on the pen with the X datum surfaces on the columns due to the bias provided by the contact of the resilient electrical interconnects 242, 252 on the pens with mating resilient electrical interconnects which have been installed in the windows of the printbar. This engagement of the pen X datum surfaces 270, 272 with the column X datum surfaces 274, 276 provides both accurate linear positioning of each pen in the X direction and prevents rotation of the pens 200 around a line parallel to the Z axis (which as shown is generally vertical) which ordinarily would occur due to pen biasing when the electrical interconnects 242, 252 on the pens resiliently engage the electrical interconnects on the printbar 100 during installation of a pen into its mounting location. FIG. 8 shows one pen having its X datum surface 272 properly positioned in contact with an X datum surface 276 on the inside of the column 130 seen to the left of the pen.

Each pen 200 also has a laterally extending positioning member in the form of a guide rail or key 280 preferably integrally formed with the pen housing and protruding from one side thereof. The key 280 extends horizontally in the X direction and vertically in the Z direction as shown and is received in an associated guide track or keyway 180 in the printbar to guide the pen into its mounting location in the printbar and provide accurate longitudinal and rotational positioning of the pens. The non-symmetrical positioning of a key 280 protruding laterally from one side of each pen 200 and associated keyways in the printbar thus prevents incorrect installation of the pens in the printbar. The ends 162 of the torsion springs 160 bias each pen 200 to urge the pen keys 280 firmly against the sides of the keyways 180 to provide accurate positioning in the Y direction. The keys thus provide datum surfaces for Y directional positioning and the firm engagement of the keys 280 with the keyways 180 and the engagement of the Z datum surfaces 260, 262, 264, 266 with the associated Z axis supports 150 on the printbar 100 prevents rotation of the pens 200 around an axis which extends parallel to the X direction.

The electrical interconnects 242, 252 are provided on both sides of the S-shaped pens 200 because there is not enough room on one side surface for all of the electrical connections which need to be made. It is desirable that the interconnects on the opposite sides of the pen be identical but, as previously mentioned due to the S configuration of the lower portion of the pen, the interconnects are not aligned with each other in the X direction. Accordingly, the contact forces generated by deflection of resilient electrical interconnects during installation of the pens 200 in the printbar 100 tends to twist the pens around axes extending in the Z direction. The X datum surfaces 270, 272 are positioned to engage like X direction datum surfaces 274, 276 on the columns 130 and thus resist the twisting moment without the necessity for special bias springs as is typical in the prior art. Accordingly, the cost of providing reliable biasing springs to oppose X direction pen motion and the increased pen-to-pen spacing required thereby is avoided leading to closer pen spacing and reduced costs.

The rotational symmetry of S-shaped pens can and does occasionally result in incorrect pen installation by the user. Good ergonomic design dictates that prevention of incorrect pen installation be prevented as early as possible in the process of installing the pen. Also, since the space between adjacent stacked pens should be reduced to the minimum necessary while preventing pen to pen contact, the Y directional bias springs 160 are provided at locations such, as shown, to the side of the pens but within the confines of the printbar 100 rather than between the end faces of the pens and engage the laterally extending keys 280 to provide the appropriate Y directional bias and resultant positioning. In the event of attempted incorrect installation of a pen 200 in the printbar 100, interference between the key 280 and the cover 140 occurs well before any electrical contact between the electrical interconnects on the pen 200 and printbar 100 is made.

Persons skilled in the art will also appreciate that various additional modifications can be made in the preferred embodiments shown and described above and that the scope of protection is limited only by the wording of the claims which follow. Parenthetical directional references in the claims are provided for convenience and are not intended as limitations on the scope of protection.

What is claimed is:

1. A method of positioning a fluid ejection device in a support to stabilize the device against movement in at least one direction relative to said support comprising urging said device into engagement with said support by biasing a surface on said device which laterally protrudes from a side of said device which extends in said direction to urge said device in said direction.

2. The method of claim 1, wherein said device ejects fluid in a first (Z) direction, and said surface on said device protrudes laterally of said device in a second (X) direction substantially orthogonal to said first direction, said biasing taking place in a third (Y) direction substantially orthogonal to said first and said second directions.

3. The method of claim 2, including supporting multiple ones of said devices in alignment on said support, and biasing laterally protruding ones of said surfaces on each of said devices in the same direction to permit close endwise spacing without contact of adjacent devices in said direction.

4. The method of claim 3, wherein said devices have electrical interconnects on generally parallel opposite sides of said devices which resiliently engage electrical interconnects on a support of generally rectangular configuration, further comprising preventing rotation of said devices around axes extending parallel to said first (Z) direction by engaging datum surfaces on opposite sides of each of said devices located proximate opposite ends of each said device with datum surfaces on opposite generally parallel sides of said support.

5. A fluid ejection assembly comprising a frame and at least one fluid ejection device positioned in a mounting location on said frame, said device including a housing for containing fluid and having a positioning key member laterally protruding from one side of said housing, said frame having a guide keyway at said mounting location for receiving said key member to guide said device into said mounting location in said frame.

6. The assembly of claim 5, wherein said frame includes a plurality of aligned mounting locations and guides and a plurality of said devices mounted in said locations without contact between adjacent ones of said devices.

7. The assembly of claim 6, further comprising supports on said frame and first datum surfaces on said devices engageable with said supports to position said devices in a first (Z) direction in said mounting locations as said members are guided in said guides.

8. The assembly of claim 7, wherein said members on said devices provide second datum surfaces for positioning said devices in a second (Y) direction relative to said frame, said second direction being substantially perpendicular to said first direction.

9. The assembly of claim 8, further comprising biasing means for biasing said key members into engagement with one side of said guide keyways.

10. The assembly of claim 9, wherein said biasing means comprise torsion springs mounted on said frame, said springs having spaced ends respectively engaged with said frame and said members.

11. The assembly of claim 10, further comprising resilient electrical interconnects on opposed sides of said housings for contacting electrical interconnects on said frame and third datum surfaces on opposed sides of said housings, said frame having surfaces urged into engagement with said third datum surfaces by said electrical interconnects.

12. The assembly of claim 11, wherein said housings have protruding fore and aft portions on opposite sides of said housing, said interconnects being received on said fore and aft portions, said third datum surfaces being positioned on said housing between said fore and aft portions.

13. An inkjet printer which includes a frame and at least one inkjet pen positioned in a stationary mounting location on said frame, said pen including a housing for containing ink and having a pen positioning key member laterally protruding from one side of said housing, said frame having a guide keyway alongside said mounting location for slidably receiving said key member to guide said pen into said mounting location in said frame.

14. The printer of claim 13, wherein said frame is generally rectangular and includes a plurality of aligned mounting locations and guide keyways and a plurality of said pens mounted in said locations.

15. The printer of claim 14, further comprising supports on said frame and first datum surfaces on said pens engageable with said supports to position said devices in a first (Z) direction in said mounting locations as said members are slidably received in said guides.

16. The printer of claim 15, wherein said key members provide second datum surfaces for positioning said pens in a second (Y) direction relative to said frame, said second direction being substantially orthogonal to said first direction.

17. The printer of claim 16, further comprising biasing means for biasing said key members into engagement with one side of said keyways.

18. The printer of claim 17, wherein said biasing means comprise torsion springs mounted on said frame, said springs having spaced ends respectively engaged with said frame and said key members on said pens.

19. The printer of claim 18, further comprising electrical interconnects on opposed sides of said housings and third datum surfaces on opposed sides of said housings, said frame having surfaces biased into engagement with said third datum surfaces by resiliency of contact of said electrical interconnects on said housings with electrical interconnects on said frame.

20. The printer of claim 19, wherein said housings have protruding fore and aft portions on opposite sides of said housings, said interconnects being received on said fore and aft portions.

* * * * *